US010723609B1

(12) United States Patent
Williams et al.

(10) Patent No.: US 10,723,609 B1
(45) Date of Patent: Jul. 28, 2020

(54) PORTABLE BOTTLE FILLING STATION

(71) Applicants: Craig A. Williams, Maumee, OH (US); R. David Grieder, Morenci, MI (US); Mark F. Moll, II, Perrysburg, OH (US); Corey M. Fuson, Monroe, MI (US); Jeffrey M. Schnapp, Toledo, OH (US)

(72) Inventors: Craig A. Williams, Maumee, OH (US); R. David Grieder, Morenci, MI (US); Mark F. Moll, II, Perrysburg, OH (US); Corey M. Fuson, Monroe, MI (US); Jeffrey M. Schnapp, Toledo, OH (US)

(73) Assignee: Designetics, Inc., Holland, OH (US)

( * ) Notice: Subject to any disclaimer, the term of this patent is extended or adjusted under 35 U.S.C. 154(b) by 0 days.

(21) Appl. No.: 15/705,351

(22) Filed: Sep. 15, 2017

Related U.S. Application Data

(60) Provisional application No. 62/395,769, filed on Sep. 16, 2016.

(51) Int. Cl.

| | |
|---|---|
| ***B67D 1/00*** | (2006.01) |
| ***B67C 3/26*** | (2006.01) |
| ***B67C 3/00*** | (2006.01) |
| ***B67C 3/22*** | (2006.01) |
| ***B67C 3/28*** | (2006.01) |

(52) U.S. Cl.
CPC ..... *B67C 3/2608* (2013.01); *B67C 3/007* (2013.01); *B67C 3/225* (2013.01); *B67C 3/282* (2013.01); *B67C 3/008* (2013.01)

(58) Field of Classification Search
CPC ..... B67C 3/225; B67C 3/282; B67C 3/008; B05B 11/3097; B67D 7/44
USPC ..... 222/571, 56; 141/2, 95, 103, 115, 116, 141/192, 198, 301
See application file for complete search history.

(56) References Cited

U.S. PATENT DOCUMENTS

| | | | | |
|---|---|---|---|---|
| 3,817,301 | A | 6/1974 | Van T'Blik | |
| 4,282,698 | A | 8/1981 | Zimmermann | |
| 4,291,519 | A | 9/1981 | Johnson | |
| 4,363,338 | A | 12/1982 | Brown | |
| 4,467,846 | A | 8/1984 | Croser | |
| 4,492,259 | A | 1/1985 | Sick et al. | |
| 5,168,905 | A * | 12/1992 | Phallen | B65B 3/36 141/1 |
| D339,845 | S | 9/1993 | Bally et al. | |
| 5,494,086 | A | 2/1996 | McBrady et al. | |
| 5,651,398 | A | 7/1997 | Decker et al. | |
| 5,720,148 | A | 2/1998 | Bedin et al. | |
| 5,862,948 | A | 1/1999 | Duchon et al. | |

(Continued)

FOREIGN PATENT DOCUMENTS

| | | |
|---|---|---|
| EP | 1236675 | 4/2002 |

*Primary Examiner* — P. Macade Nichols
(74) *Attorney, Agent, or Firm* — Donald K. Wedding

(57) ABSTRACT

Containers of the same or different size are filled with a non-viscous fluid at discrete stations, each container being filled independently of each other container. Multiple containers of the same or different size are positioned at multiple discrete stations, each container being at a different station. A non-viscous fluid is flowed into a container to a desired level. The level is sensed with a level sensor and the fluid flow stopped at the desired level. The fluid flow is reversed to prevent fluid dripping when a filled bottle is removed.

4 Claims, 8 Drawing Sheets

(56) References Cited

U.S. PATENT DOCUMENTS

| | | | | |
|---|---|---|---|---|
| 5,954,240 | A | 9/1999 | Duchon et al. | |
| 6,129,125 | A | 10/2000 | Duchon et al. | |
| 6,202,831 | B1 | 3/2001 | Manthei | |
| 6,682,601 | B1 * | 1/2004 | Beebe | B05C 17/00553 118/669 |
| 7,328,818 | B2 | 2/2008 | Prabucki | |
| 7,404,277 | B2 | 7/2008 | Schach et al. | |
| 7,490,739 | B2 | 2/2009 | Prabucki | |
| 7,703,483 | B2 | 4/2010 | Hartman et al. | |
| 9,150,399 | B2 | 10/2015 | Michelli et al. | |
| 9,296,599 | B2 | 3/2016 | Forestelli et al. | |
| 9,302,895 | B2 | 4/2016 | Clusserath | |
| 2005/0127103 | A1 * | 6/2005 | Reid | A23G 9/28 222/190 |
| 2011/0070348 | A1 * | 3/2011 | Burton-Wilcock | A47J 31/46 426/431 |
| 2013/0001044 | A1 | 1/2013 | Ronchi | |
| 2016/0052766 | A1 | 2/2016 | Fahldieck | |

* cited by examiner

PORTABLE BOTTLE FILLING STATION

RELATED APPLICATION

This application claims priority under 35 U.S.C. 119 (e) of U.S. Provisional Application Ser. No. 62/395,769 filed Sep. 16, 2016.

INTRODUCTION

This invention relates to a portable machine for filling containers of different sizes with a non-viscous fluid. The machine comprises a plurality of discrete stations for filling containers, such as bottles, with fluid independently of each other. There is disclosed apparatus, method, and system for filling containers of the same or different size with a non-viscous fluid at discrete stations, each container being filled independently of each other container. Multiple containers of the same or different size are positioned at multiple discrete stations, each container being at a different station. A non-viscous fluid is flowed into a container to a desired level. The level is sensed with a level sensor and the fluid flow stopped at the desired level. The fluid flow is stopped to prevent fluid dripping when a filled bottle is removed.

PRIOR ART

Examples of bottle filling stations in the prior art are disclosed in U.S. Pat. No. 4,291,519 (Johnson), U.S. Pat. No. 4,467,846 (Croser), U.S. Pat. No. 4,492,259 (Sick et al.), U.S. Pat. No. 5,494,086 (McBrady et al.), U.S. Pat. No. 5,651,398 (Decker et al.), U.S. Pat. No. 5,720,148 (Bedin et al.), U.S. Pat. No. 5,862,948 (Duchon et al.), U.S. Pat. No. 5,954,240 (Duchon et al.), U.S. Pat. No. 6,129,125 (Duchon et al.), U.S. Pat. No. 6,202,831 (Manthei), U.S. Pat. No. 7,328,818 (Prabucki), U.S. Pat. No. 7,490,739 (Prabucki), U.S. Pat. No. 7,404,277 (Schach et al.), U.S. Pat. No. 7,703,483 (Hartman et al.), U.S. Pat. No. 9,150,399 (Michelli et al.), U.S. Pat. No. 9,296,599 (Forestelli et al.), U.S. Design Pat. No. D339,845 (Bally et al.), and U.S. Patent Application Publication No. 2013/0001044 (Ronchi), all incorporated herein by reference. An example of dispending liquid in the prior art is disclosed in European Patent EP 1236675 (Tansley et al.), incorporated herein by reference. Examples of liquid filling machines in the prior art are disclosed in U.S. Pat. No. 3,817,301 (Van T'Blik), U.S. Pat. No. 4,282,698 (Zimmerman), U.S. Pat. No. 4,363,338 (Brown), U.S. Pat. No. 9,302,895 (Clusserath), and U.S. Patent Application Publication 2016/0052766 (Fahldieck), all incorporated herein by reference.

SUMMARY OF INVENTION

The machine comprises an enclosure for housing a human-machine interface, a plurality of peristaltic pump assemblies, filling station, touch system human-machine interface with programmable logic controller and Ethernet port on the filling station, indicator light, push button switches, lockout power switch, filling tray with cover, invertible bottle nests, variable electric motor drivers, electric motors, power supply, level sensors, AC power cable, and cooling fan.

The portable machine, or unit, is used to fill bottles with a non-viscous fluid. The machine is operated by a human-machine interface. The unit is plugged into a standard 120 VAC outlet via a standard three-prong AC power cable. The power to the unit is engaged by a lockout power switch located on the right side of the unit. The human-machine interface, or HMI, display on the front panel of the unit indicates the presence or absence of a bottle on an invertible bottle nest. If the bottle nest(s) is in the correct configuration for large and/or small bottles, the nozzle of the desired pump is lifted by a knob and held in place while the selected bottle is placed in the bottle nest. The nozzle knob is released lowering the nozzle into the bottle opening. The START button of the desired pump is pressed to begin the process of filling the bottle with non-viscous fluid. The bottle begins the process of filling. The bottle fills until the desired level is sensed by a level sensor and then stops. The HMI display indicates a full bottle that is ready for removal. The nozzle knob is lifted to remove the filled bottle from the unit. If the bottle nest(s) is not in the correct configuration for large and/or small bottles, the bottle nest configuration must be changed to accommodate the desired bottle size. The bottle nests are affixed to the enclosure cover with thumb screw found either on the top or on the bottom of the seat depending on the configuration. Once the thumb screw is removed from the bottle nest, the nest is pulled away from the panel exposing two pegs on the panel. The nest is rotated 180° and the exposed pegs are lined up and pressed into two holes in the nest. The thumb screw is reinserted into a threaded hole and fastened finger tight into the panel. The thumb screw hole will be on the top or the bottom, based on the bottle holder seat configuration. When the bottle nests are in the correct configuration for large and/or small bottles, the nozzle of the desired pump is lifted by a knob and held in place while the selected bottle is placed in the bottle nest. The nozzle knob is released lowering the nozzle into the bottle opening. The START button of the desired pump is pressed to begin the process of filling the bottle with non-viscous fluid. The bottle begins the process of filling. The bottle fills until the desired level is sensed by a level sensor that stops the pump and initiates another pump in reverse to draw the fluid away from the nozzle, preventing the fluid from dripping out of the nozzle. The HMI display indicates a full bottle that is ready for removal. The nozzle knob is lifted to remove the filled bottle from the unit and allow the return to its neutral position. The HMI now indicates the absence of a bottle present in the bottle holder.

DETAILED DESCRIPTION OF THE DRAWINGS

Figure 1:
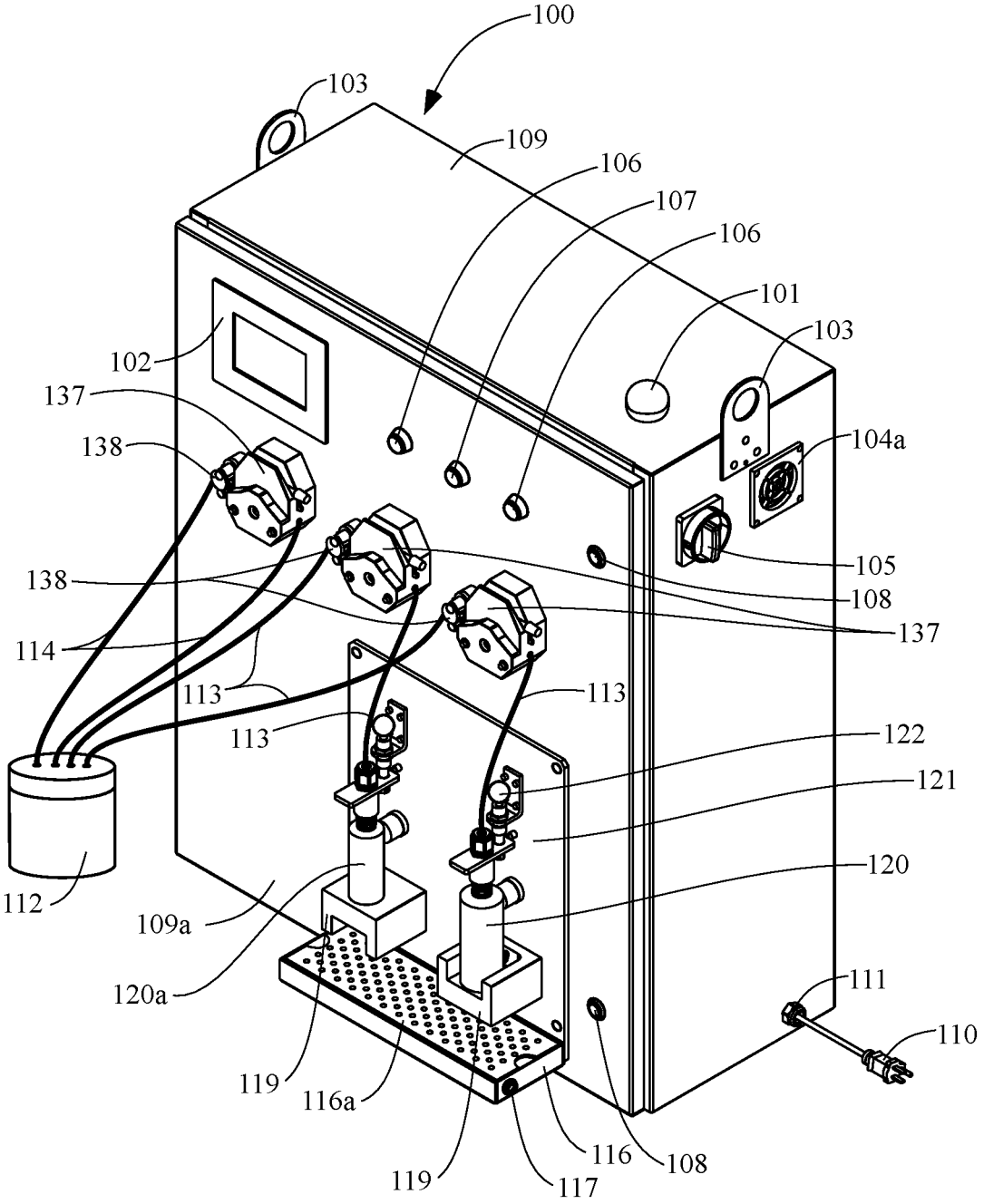
FIG. 1 is a perspective view of the unit.

FIG. 1 is a perspective view of the unit 100 containing two bottle filling stations. Illustrated herein are: a two-color dome-style indicator light 101 for indicating the operational status of the unit, a human-machine interface (HMI) with programmable logic controller, Ethernet connector, liquid crystal display, and touch system 102, bolt on lifting lugs 103, cooling fan filter and guard **104*a*, two-position, three-pole lockout power switch 105, green push button switches 106 for starting the peristaltic pumps 137, red push button switch 107 for stopping the peristaltic pumps 137, panel latch 108, enclosure 109, enclosure panel 109***a*, three-prong AC cable 110, cord grip 111, fluid reservoir 112, supply tubing 113, recirculation tubing 114, bottle filling spill tray 116, bottle filling spill tray cover 116*a*, pipe plug 117, two invertible bottle nests 119, large bottle 120, small bottle 120*a*, filling station plate 121, cleat assembly 138, and nozzle knob 122.

Once the unit is powered on and is ready to fill, the indicator light 101 glows yellow as a warning of low fluid and red when stopped. A bottle 120 or 120*a* is placed into a bottle nest 119 and a push button switch 106 is depressed, starting the peristaltic pump 137. A non-viscous fluid is drawn into the supply tubing 113 from the fluid reservoir 112 and dispensed into the bottle 120 or 120*a* through a nozzle (not shown). When filling is complete, the peristaltic pump 137 is initiated in reverse, drawing fluid back into the fluid reservoir 112 preventing the nozzles from dripping when the bottle is removed.

Figure 2:
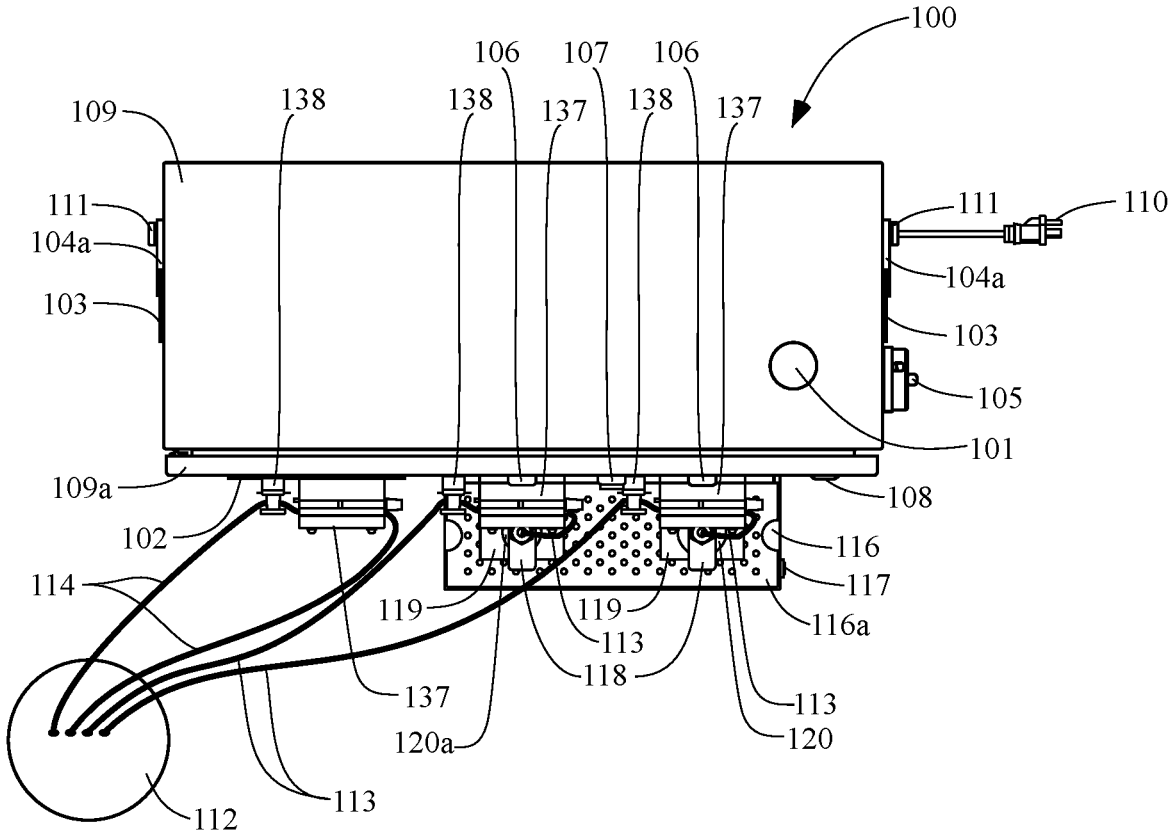
FIG. 2 is a top view of the unit.

FIG. 2 is a top view of the unit 100 containing two bottle filling stations. Illustrated herein are: a two-color dome-style indicator light 101, a human-machine interface (HMI) 102, bolt on lifting lugs 103, cooling fan filters and guards 104*a*, power switch 105, green push button switches 106, peristaltic pumps 137, red push button switch 107, panel latch 108, enclosure 109, enclosure panel 109*a*, three-prong AC cable 110, cord grips 111, fluid reservoir 112, supply tubing 113, recirculation tubing 114, bottle filling spill tray 116, bottle filling spill tray cover 116*a*, pipe plug 117, invertible bottle nests 119, nozzle mounting brackets 118, large bottle 120, small bottle 120*a*, and cleat assemblies 138.

Figure 3:
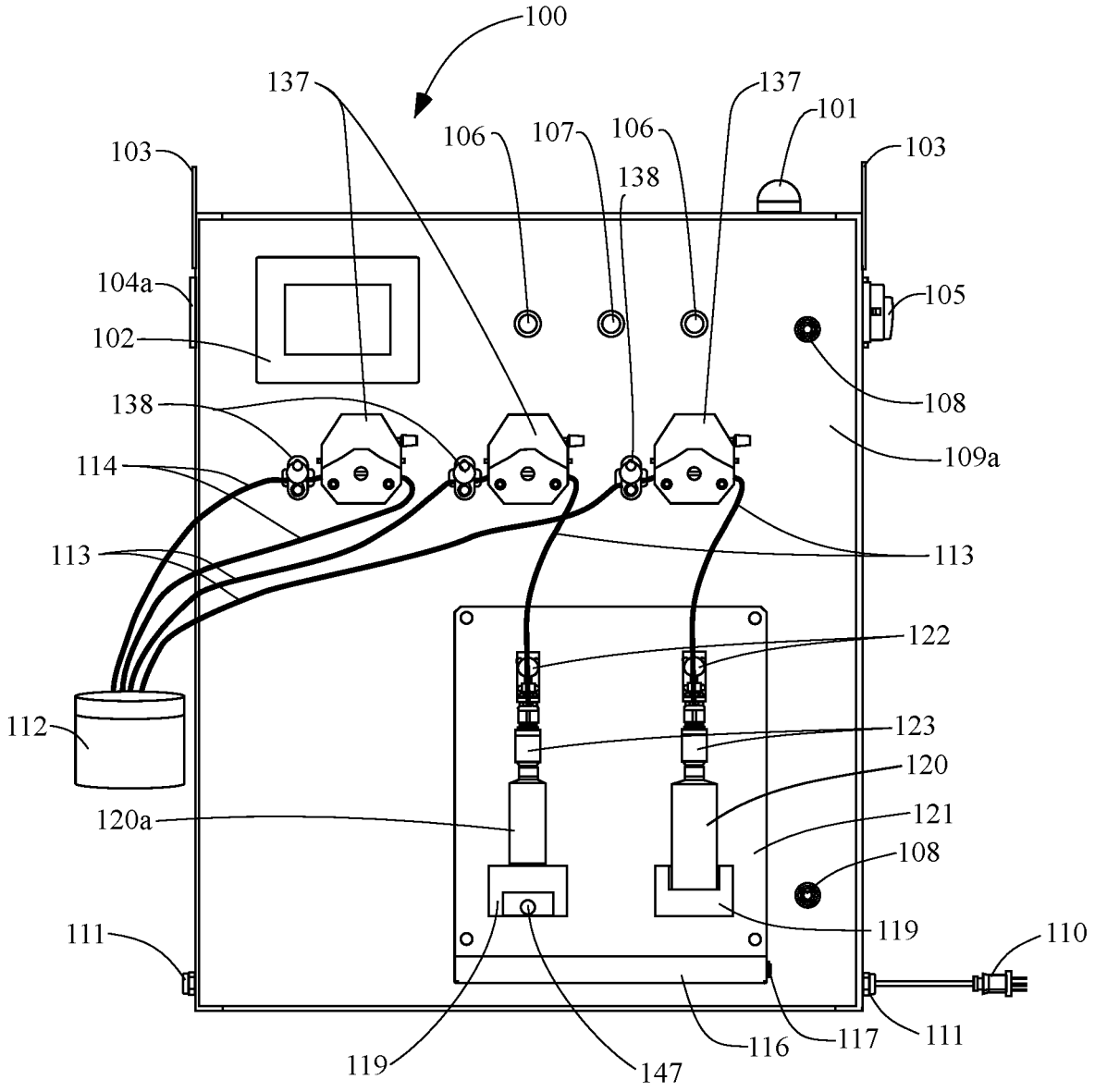
FIG. 3 is a front elevation view of the unit.

FIG. 3 is a front elevation view of the unit 100 containing two bottle filling stations. Illustrated herein are a two-color dome-style indicator light 101, a human-machine interface (HMI) 102, bolt on lifting lugs 103, cooling fan filter and guard 104*a*, power switch 105, green push button switches 106, peristaltic pumps 137, red push button switch 107, panel latches 108, enclosure panel 109*a*, three-prong AC cable 110, cord grips 111, fluid reservoir 112, supply tubing 113, recirculation tubing 114, bottle filling spill tray 116, pipe plug 117, invertible bottle nests 119, large bottle 120, small bottle 120*a*, filling station plate 121, cleat assemblies 138, nozzles 123, bottle nest thumb screw 147 for affixing the bottle nests 119 to the enclosure panel 109*a*, and nozzle knobs 122.

Figure 4:
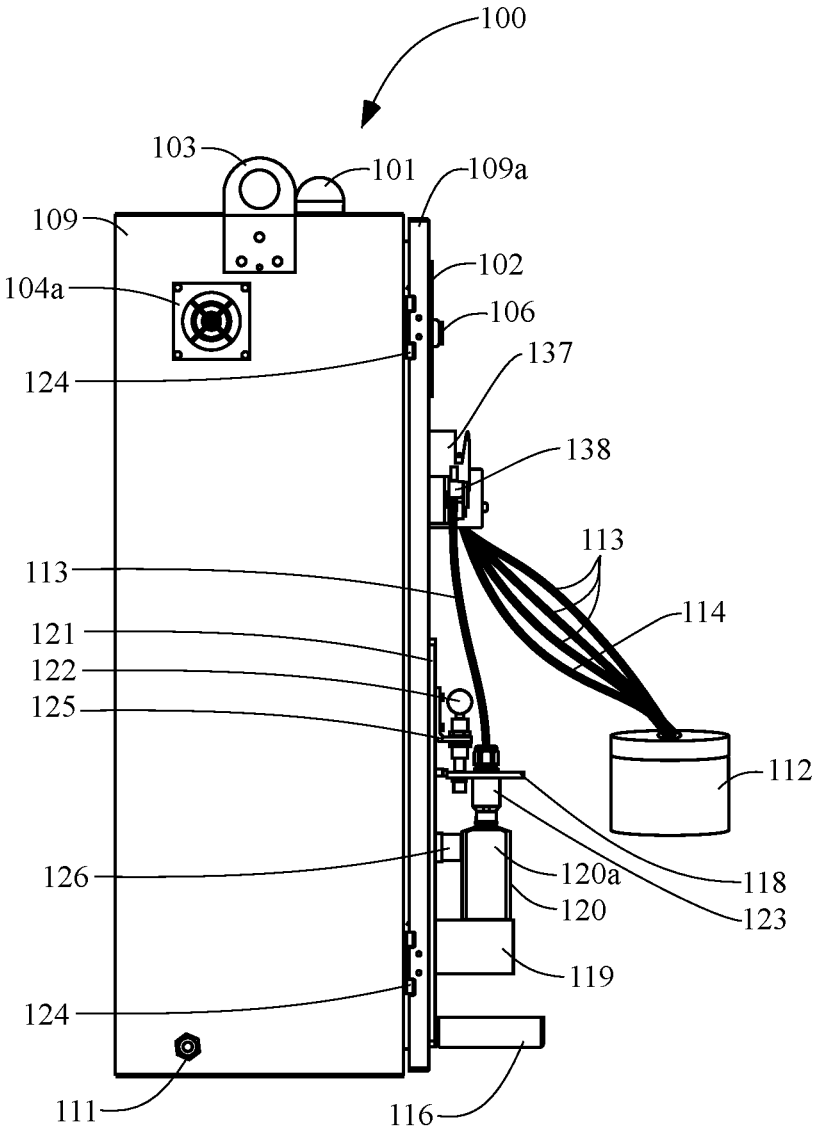
FIG. 4 is a left side view of the unit.

FIG. 4 is a left side view of the unit 100 containing two bottle filling stations. Illustrated herein are: a two-color dome-style indicator light 101, a human-machine interface (HMI) 102, bolt on lifting lug 103, cooling fan filter and guard 104*a*, green push button switch 106, peristaltic pump 137, enclosure 109, enclosure panel 109*a*, cord grip 111, fluid reservoir 112, supply tubing 113, recirculation tubing 114, bottle filling spill tray 116, invertible bottle nest 119, large bottle 120, small bottle 120*a*, filling station plate 121, cleat assembly 138, nozzle 123, nozzle mounting brackets 118, knob mounting bracket 125, panel hinges 124, level sensor 126 for determining the amount of fluid in the bottles 120 and 120*a*, and nozzle knobs 122. The nozzle mounting brackets 118 may contain a proximity switch to prevent flow without a bottle.

Figure 5:
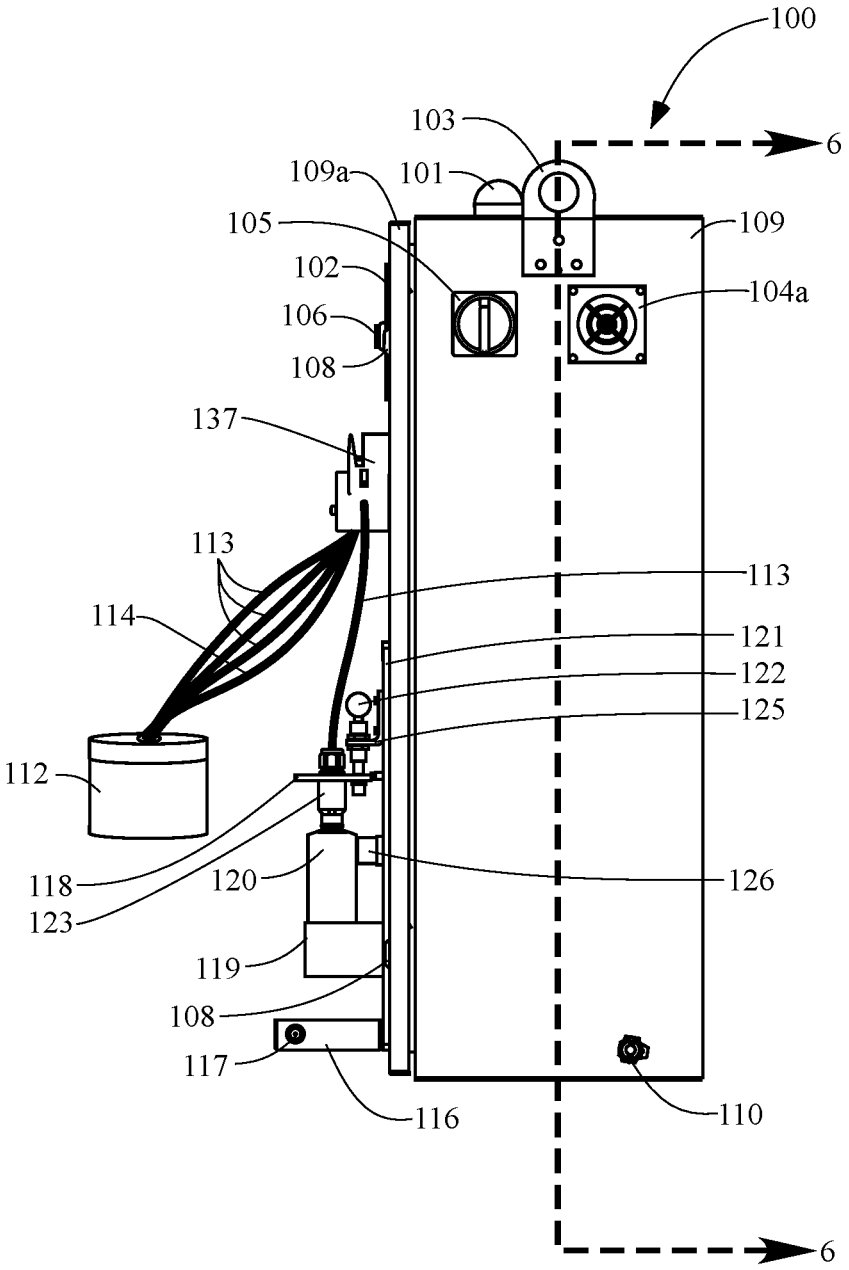
FIG. 5 is a right side view of the unit.

FIG. 5 is a right side view of the unit 100 containing two bottle filling stations. Illustrated herein are: a two-color dome-style indicator light 101, a human-machine interface (HMI) 102, bolt on lifting lugs 103, cooling fan filter and guard 104*a*, power switch 105, green push button switch 106, peristaltic pump 137, panel latches 108, enclosure panel 109*a*, enclosure 109, three-prong AC cable 110, fluid reservoir 112, supply tubing 113, recirculation tubing 114, bottle filling spill tray 116, pipe plug 117, invertible bottle nest 119, large bottle 120, filling station plate 121, nozzle 123, nozzle mounting brackets 118, knob mounting bracket 125, level sensor 126, and nozzle knobs 122. The nozzle mounting brackets 118 may contain a proximity switch to prevent flow without a bottle.

Figure 6:
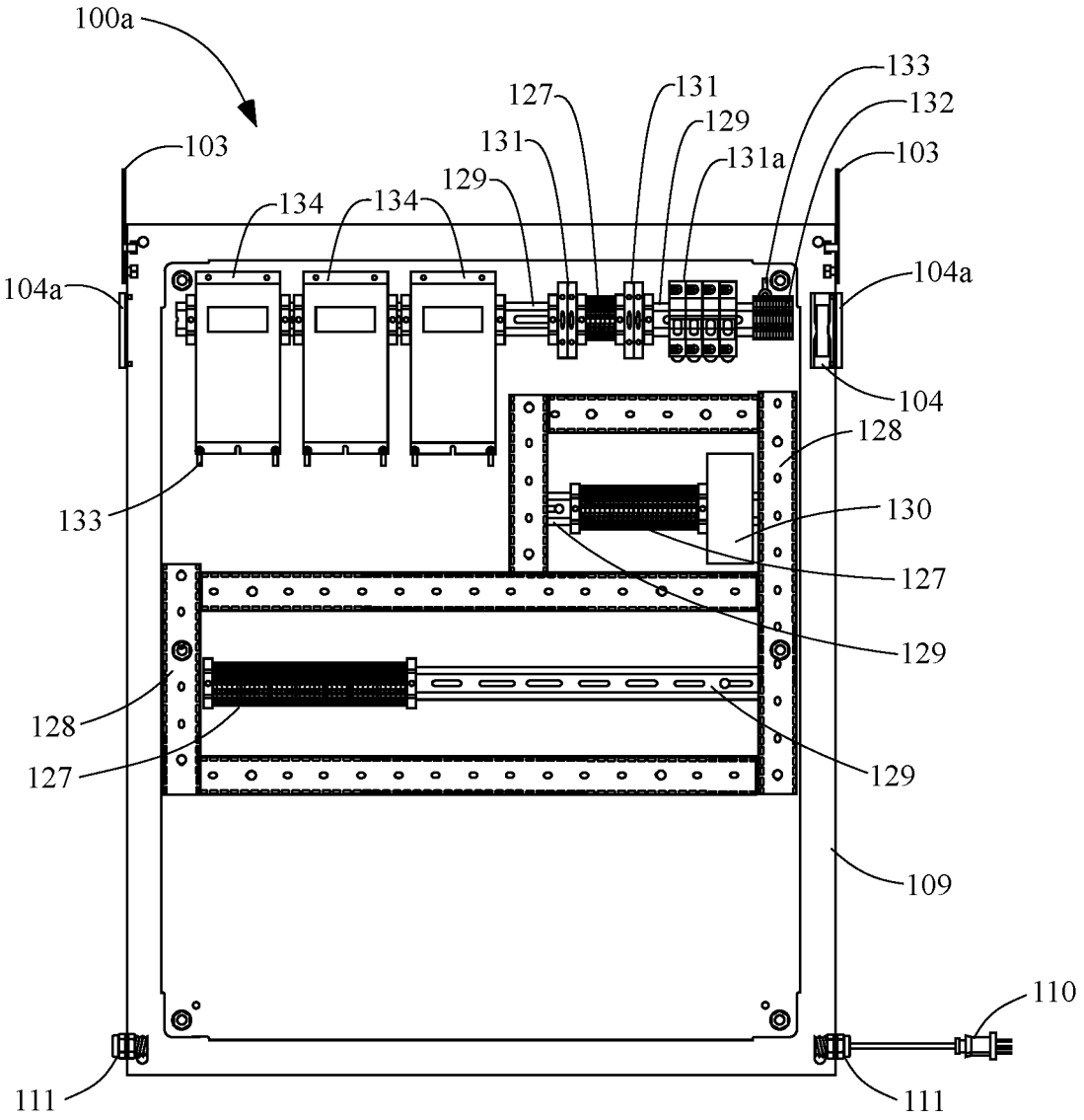
FIG. 6 is a section 6-6 view of the unit.

FIG. 6 is a section 6-6 view of the unit 100*a* containing two bottle filling stations. Illustrated herein are: bolt on lifting lugs 103, cooling fan filters and guards 104*a*, cooling fan 104 for preventing the interior of the enclosure from overheating, enclosure 109, three-prong AC cable 110, cord grips 11, multiple sizes of terminal blocks with end barrier, ground, and end stop 127, wire ducts 128 of varying lengths for housing the wiring being connected to various components held within the enclosure 109, mounting rails 129 of varying lengths to mount the components to the enclosure 109, power supply 130 for converting the incoming AC (alternating current) voltage into DC (direct current) to be used by the variable electric motor drivers 134 and other components through the fuse blocks 131 and 131*a*, ring terminals 132 for connecting the motor drivers 134 to the motors (not shown), and to ground at the ground terminals 133.

Figure 7:
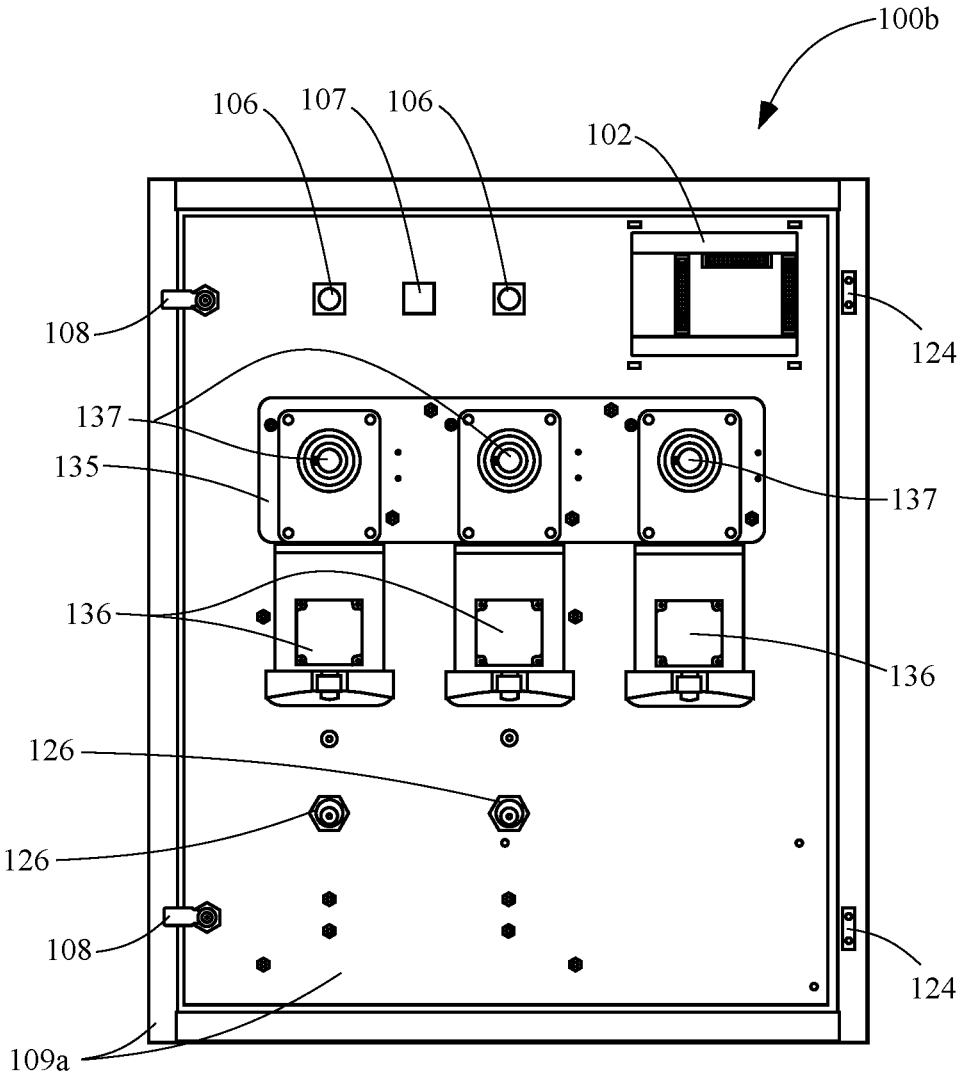
FIG. 7 is a cover back view of the unit.

FIG. 7 is an enclosure panel 109*a* back view of the unit 100*b*. Illustrated herein are: the backs of: the HMI 102, the green push button switches 106, red push button switch 107, peristaltic pumps 137, panel latches 108, enclosure panel 109*a*, pump mounting plate 135, electric motors 136, panel hinges 124, and level sensors 126.

Figure 8:
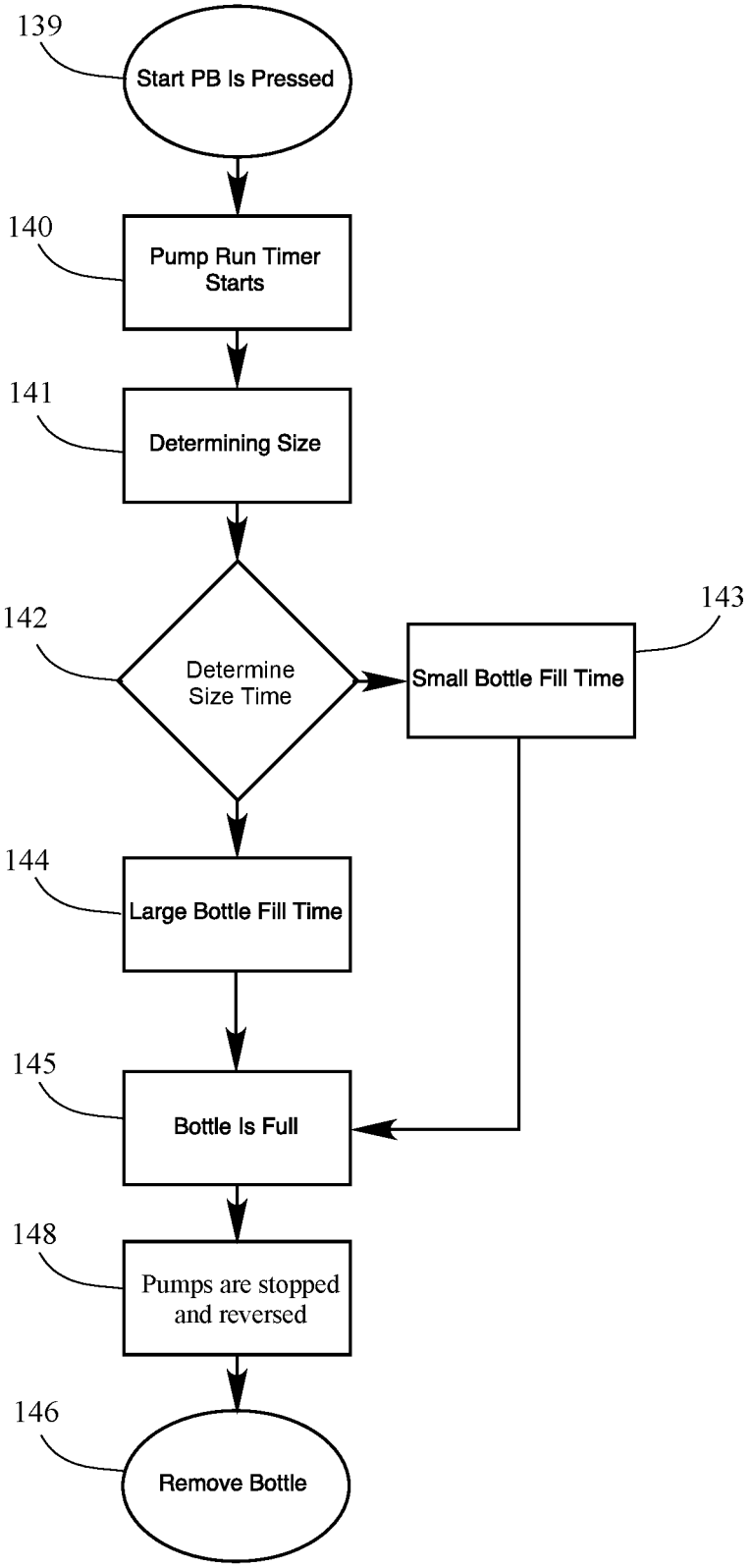
FIG. 8 is a block diagram regarding the operation of the unit.

FIG. 8 is a block diagram regarding the operation of the unit. If a small bottle is to be filled: The start button is pressed 139, a pump run timer is initiated 140, the size of the bottle is determined 141, the filling time is determined 142, a small bottle the fill time is run 143, until the bottle is filled 145, the pumps are stopped and reversed 148, and the bottle is removed 146. If a large bottle is to be filled: The start button is pressed 139, a pump run timer is initiated 140, the size of the bottle is determined 141, the filling time is determined 142, a large bottle the fill time is run 144, until the bottle is filled 145, the pumps are stopped and reversed 148, and the bottle is removed 146.

SUMMARY

The foregoing description of various preferred embodiments of the invention has been presented for purposes of illustration and description. It is not intended to be exhaustive or to limit the invention to the precise forms disclosed. Obvious modifications or variations are possible in light of the above teachings.

The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. A method for filling containers of different sizes with a non-viscous fluid at discrete fixed stations, each container being located at a fixed station and filled independently of each other containers located at other fixed stations, said method comprising:

placing multiple containers of different sizes at multiple discrete fixed stations, each container being at a different fixed station, flowing a non-viscous fluid into each container to a desired level with a peristaltic pump, separately sensing the level in each container with a level sensor and stopping the fluid flow at the desired level in each different size container at its fixed location, and reversing the fluid flow with said peristaltic pump to prevent fluid dripping when a filled container is removed.

2. A system for filling containers of the same or different size with a non-viscous fluid at discrete fixed stations, each container being located at a fixed station and filled independently of each other containers located at other fixed stations, said system comprising:

placing multiple containers of the same or different size at multiple discrete stations, each container being at a different fixed station, flowing a non-viscous fluid into each container to a desired level with a peristaltic pump, separately sensing the level in each container with a level sensor and stopping the fluid flow at the desired level in each container at its fixed location, and reversing the fluid flow with said peristaltic pump to prevent fluid dripping when a filled container is removed.

3. Apparatus for filling containers of different sizes with a non-viscous fluid at discrete fixed stations, each container being located at a fixed station and filled independently of each other containers located at other fixed stations, said apparatus comprising:

multiple discrete fixed stations for positioning containers different sizes, each container being at a different fixed station, A peristaltic pump for flowing a non-viscous fluid into each different size container to a desired level, A sensor level for sensing the level and stopping the fluid flow at the desired level, and means for reversing the peristaltic pump and non-viscous fluid flow to prevent fluid dripping when a filled container is removed.

4. The system of claim 2 wherein the containers are of different sizes.

* * * * *